US012152402B1

(12) United States Patent
Zhang

(10) Patent No.: US 12,152,402 B1
(45) Date of Patent: Nov. 26, 2024

(54) SIDE STRUCTURE OF FENCE FRAMEWORK, FENCE FRAMEWORK, FENCE, AND FOLDING METHOD THEREOF

(71) Applicant: XIAMEN HONOR INDUSTRY AND TRADING CO., LTD, Xiamen (CN)

(72) Inventor: Jian Yong Zhang, Xiamen (CN)

(73) Assignee: XIAMEN HONOR INDUSTRY AND TRADING CO.,LTD

( * ) Notice: Subject to any disclaimer, the term of this patent is extended or adjusted under 35 U.S.C. 154(b) by 0 days.

(21) Appl. No.: 18/786,650

(22) Filed: Jul. 29, 2024

(30) Foreign Application Priority Data

May 21, 2024 (CN) ..... 202410626912.3
May 21, 2024 (CN) ..... 202421104875.1

(51) Int. Cl.
*E04H 17/18* (2006.01)

(52) U.S. Cl.
CPC ..... *E04H 17/185* (2021.01)

(58) Field of Classification Search
CPC .... A47D 13/06; A47D 13/061; A47D 13/063; A47D 13/066; A47D 13/068; E04B 1/343; E04B 1/34357; E04B 1/34384; E04B 1/344; E04H 17/18; E04H 17/185
See application file for complete search history.

(56) References Cited

U.S. PATENT DOCUMENTS 639,703 A * 12/1899 Bent ..... A47D 13/063 5/99.1
3,063,065 A * 11/1962 Shaw ..... A47D 13/063 5/99.1
3,474,472 A * 10/1969 Hamilton ..... A47D 13/063 5/98.1
4,070,716 A * 1/1978 Satt ..... A47D 13/063 5/99.1
10,609,895 B2 * 4/2020 Ishisako ..... A01K 1/035
11,109,691 B2 * 9/2021 Fusco ..... A47D 13/061
11,147,392 B2 * 10/2021 Mountz ..... A47D 13/061
11,206,932 B2 * 12/2021 Ning ..... A47D 13/061

FOREIGN PATENT DOCUMENTS

CN 205696843 U * 11/2016
CN 112294031 A * 2/2021 ..... A47D 13/061
CN 113180411 A * 7/2021 ..... A47D 7/002
CN 113679206 A * 11/2021

* cited by examiner

*Primary Examiner* — Jonathan P Masinick
(74) *Attorney, Agent, or Firm* — Jose Cherson Weissbrot

(57) ABSTRACT

A side structure of a fence framework, a fence framework, a fence, and a folding method thereof are provided. The side structure includes a first rod body, a second rod body, a third rod body, a hinge assembly, a second support rod, a fourth component, a fifth component, and a sixth component. The first rod body and the second rod body are arranged on the left and right, the third rod body is located at a lower side of the second rod body, and the first to third rod bodies are connected by the hinge assembly. The second support rod is located on a side of the second rod body, the fourth component is slidably sleeved on an outer side of the second support rod and hinged with one end of the third rod body, the fifth component is fixed on the outer side of the second support rod.

13 Claims, 8 Drawing Sheets

SIDE STRUCTURE OF FENCE FRAMEWORK, FENCE FRAMEWORK, FENCE, AND FOLDING METHOD THEREOF

CROSS REFERENCE TO THE REPLATED APPLICATIONS

This application is based upon and claims priority to Chinese Patent Applications No. 202410626912.3 and No. 202421104875.1, both filed on May 21, 2024, the entire contents of which are incorporated herein by reference.

TECHNICAL FIELD

The present invention relates to the technical field of fences, and in particular to a side structure of a fence framework, a fence framework, a fence, and a folding method thereof.

BACKGROUND

Baby fence is very necessary to be used to restrict a toddler who just learns to crawl or walk in a specific safe playing zone. Existing baby fences are mostly assembled by fence panels. Such baby fences are usually disassembled into separate fence panels during transportation, and consumers need to assemble them by themselves after purchasing.

The fence previously developed by the applicant is described in the Chinese patent application with the publication number CN113633134A, where a side structure of a fence framework includes two vertical support rods arranged at intervals; and between the two vertical support rods, the following are provided: two upper rod bodies arranged in a transverse direction, where two ends of the two upper rod bodies away from each other are respectively detachably connected to upper ends of the two vertical support rods, two ends of the two upper rod bodies adjacent to each other are connected rotatably relative to each other, and the two upper rod bodies approach to each other by rotating downward after being detached from the upper ends of the vertical support rods; two lower rod bodies arranged in a transverse direction, where two ends of the two lower rod bodies away from each other are respectively configured as being capable of rotating relative to lower ends of the two vertical support rods, two ends of the two lower rod bodies adjacent to each other are connected rotatably relative to each other, and the two lower rod bodies approach to each other by rotating upward relative to the lower ends of the vertical support rods; two oblique support rods, where two ends of the two oblique support rods away from each other are respectively configured as being capable of rotating relative to the lower ends of the two vertical support rods, two ends of the two oblique support rods adjacent to each other are connected rotatably at the joint of the two upper rod bodies, and the two oblique support rods approach to each other by rotating upward relative to the lower ends of the vertical support rods.

Specifically, the side structure of the fence framework is provided with a pair of a first upper rod body and a second upper rod body with a large length, the two upper rod bodies are connected and supported by a single intermediate connector and a pair of oblique support rods. Unfortunately, when suffering from significant external forces, this configuration shows the drawback of poor support efficiency, exposing its shortcomings in bearing capacity and stability.

SUMMARY

To this end, it is necessary to provide a side structure of a fence framework, a fence framework, a fence, and a folding method thereof, so as to solve the existing problem that the side structure of the fence framework is provided with a pair of a first upper rod body and a second upper rod body with a large length, the two upper rod bodies are connected and supported by a single intermediate connector and a pair of oblique support rods, and when suffering from significant external forces, this configuration shows the drawback of poor support efficiency, exposing its shortcomings in bearing capacity and stability.

To achieve the above objective, the present invention provides a side structure of a fence framework, including a first rod body, a second rod body, a third rod body, a hinge assembly, a second support rod, a fourth component, a fifth component, and a sixth component;

the first rod body and the second rod body are arranged on the left and right, the third rod body is located at a lower side of the second rod body, and the first rod body, the second rod body, and the third rod body are connected by the hinge assembly, so that the first rod body, the second rod body, and the third rod body can rotate toward or away from each other;

the second support rod is located on a side of the second rod body away from the third rod body, the fourth component is slidably sleeved on an outer side of the second support rod and hinged with one end of the third rod body away from the first rod body, the fifth component is fixed on the outer side of the second support rod and located above the fourth component, the fifth component and the fourth component each are provided with a limiting structure, the sixth component is provided at an upper end of the second support rod and hinged with one end of the second rod body away from the first rod body.

Further, the hinge assembly includes a first assembly, a second assembly, and a third assembly. The first assembly is connected to the first rod body, and the first assembly is provided with a first hinge hole and a second hinge hole that are spaced up and down. The first hinge hole is hinged with the second assembly, and an end of the second assembly away from the first hinge hole is connected to the second rod body. The second hinge hole is hinged with the third assembly, and an end of the third assembly away from the second hinge hole is hinged with the third rod body.

Further, the first assembly includes a first component and a first connecting member, the first component is connected to the first rod body, the first connecting member includes a first connecting portion and a second connecting portion, the first connecting portion and the second connecting portion are set at a first predetermined angle, the first connecting portion is connected to the first component, and the second connecting portion is provided with the first hinge hole and the second hinge hole;

the second assembly includes a second component and a second connecting member, the second component is connected to the second rod body, an end of the second component away from the second rod body is provided with a first hinge portion that can be inserted by the second connecting portion, the first hinge portion is provided with a first groove hole on both sides of the first hinge hole, the second connecting member is located on a front or rear side of the second rod body, the second connecting member has a first connecting hole, and the first connecting hole, the first groove hole, and the first hinge hole are coaxial and a first pin runs therethrough;

the third assembly includes a third component and a third connecting member, the third component is connected to the third rod body, an end of the third component away from the third rod body is provided with a second hinge portion that can be inserted by the second connecting portion, the second hinge portion is provided with a second groove hole on both sides of the second hinge hole, the third connecting member is located on a front or rear side of the third rod body, the third connecting member has a second connecting hole, and the second connecting hole, the second groove hole, and the second hinge hole are coaxial and a second pin runs therethrough.

Further, the second component has a first limiting protrusion, and the first limiting protrusion is arranged on a side of the second component facing the third component;

the third component has a second limiting protrusion, and the second limiting protrusion is arranged on a side of the third component facing the second component;

the first limiting protrusion has a first limiting surface, the first limiting surface faces the second rod body, the second limiting protrusion has a second limiting surface, the second limiting surface depart from the third rod body, and the first limiting surface and the second limiting surface can abut against each other, so that the second rod body and the third rod body remain relatively fixed.

Further, the second connecting member is provided with a third limiting protrusion, the third limiting protrusion has a third limiting surface, and the third limiting surface and the first limiting surface are placed on the same reference plane. The third connecting member is provided with a fourth limiting protrusion, the fourth limiting protrusion has a fourth limiting surface, and the fourth limiting surface and the second limiting surface are placed on the same reference plane.

Further, the fourth component is provided with a fourth connecting portion and at least one third connecting portion, one of the at least one third connecting portion is hinged with one third rod body, the fourth connecting portion is sleeved on an outside of the second support rod, the fourth component can slide up and down relative to the second support rod, the fourth connecting portion is provided with a first pressing hole, the third connecting portion has a first rotating opening, and the third rod body can rotate relative to the third connecting portion in the first rotating opening;

the second support rod is provided with a first limiting member, a part of the first limiting member protrudes out of an outer side wall of the second support rod, and a first elastic member is provided between the first limiting member and the second support rod;

when the fourth component moves to a predetermined position, the first limiting member is placed in the first pressing hole, and a part of the first limiting member protrudes out of the first pressing hole, so that the fourth component is fixed relative to the second support rod.

Further, the fifth component has a non-circular cross section and can be inserted into the fourth connecting portion of the fourth component. A cross section of the fourth connecting portion is matched with the non-circular cross section of the fifth component.

Further, the limiting structure includes the first limiting member, and the first limiting member is arranged on the fifth component through the first elastic member. The fifth component has a fifth limiting protrusion, and the fifth limiting protrusion is placed at a predetermined position to limit the fourth component.

Further, a third support rod is included. An upper end of the third support rod is provided with the sixth component. The third support rod is parallel to the second support rod.

To achieve the above objective, the present invention further provides a fence framework, including a side structure, a seventh component, a first support rod, an eighth component, and a ninth component. The side structure is the side structure of the fence framework described in any of the above embodiments. An end of the first rod body of the side structure away from the second rod body is hinged with the seventh component, a middle of the seventh component is hinged with an upper end of the first support rod, the eighth component is slidably sleeved on an outside of the first support rod, the eighth component is hinged with one end of the fourth rod body, the other end of the fourth rod body is hinged with the ninth component, the ninth component is fixed to a bottom end of the second support rod, and two side structures and two ninth components are symmetrically arranged on the left and right sides of the seventh component and the first support rod to form a frame unit.

Further, four frame units form the fence framework, where two adjacent frame units share the ninth component as well as the sixth component, the fifth component, the fourth component, and the second support rod of the side structure, and the fence framework is in a shape of a rectangular frame.

To achieve the above objective, the present invention further provides a fence, including the fence framework described in the above embodiment and a fabric cover covering the side and bottom of the fence framework.

To achieve the above objective, the present invention further provides a folding method of a fence, which is applicable to the fence described in the above embodiment. The folding method includes:

controlling the second rod body and the third rod body to rotate away from each other relative to the hinge assembly;

controlling the first rod body to rotate downward to a first limited position relative to the first support rod;

controlling the second rod body to rotate to a second limited position relative to the second support rod; and controlling the third rod body to slide downward to a third limited position relative to the second support rod, so as to drive the second support rod to fold toward the first support rod.

The above technical solutions have the following technical effects:

The first innovative point of this embodiment is that the first rod body and the second rod body (forming an integrated structure equivalent to the first upper rod body or the second upper rod body of the prior art) are arranged horizontally on the left and right, the third rod body is located below the second rod body, and a stable triangular foundation is formed by the third rod body, the second rod body, and the second support rod. The first rod body, the second rod body, and the third rod body are connected by the hinge assembly that is carefully designed, achieving flexible rotation therebetween. Whether relative rotation or opposite movement, the overall structure can be ensured to adapt to different terrain conditions and external force impacts.

The second innovation point of this embodiment is that not only the second support rod provides direct auxiliary support for the second rod body, but also the fourth component in a sliding sleeve design gives the system more adjustment space. The fifth component serves as a limiting device and is fixed on the second support rod, effectively controlling the range of movement of the fourth component and ensuring the stability of the structure during dynamic adjustment.

That is, when an external force acts on the fence, the hinge assembly among the first to third rod bodies allows the structure to deform within a certain range and absorb energy, while the second support rod and its components play a role in dynamic adjustment and enhanced support. The sliding and hinge mechanism of the fourth component enables automatically fine adjustment of the fence according to the force condition, and the limiting structure of the fifth component avoids excessive deformation, ensuring structural safety. The addition of the sixth component provides additional vertical support and stability for the overall structure through hinge connection between the sixth component and the second rod body.

In addition, the length of the first rod body or the second rod body is significantly shortened compared to the length of the first upper rod body or the second upper rod body in the prior art, making it more convenient to be folded and greatly reducing the volume during storage. The compact size after folding not only facilitates transportation and storage, but also reduces the space occupied in the non-use state, improving the convenience and practicality in use.

The above recitation of the present invention is only a summary of the technical solutions of the present invention. To enable those of ordinary skills in the art to more clearly understand the technical solutions of the present invention and then to implement them according to the text of the specification and the contents recorded in the drawings, and to facilitate the understanding of the above objectives, as well as other purposes, features, and advantages of the present invention, the following is a description in combination with the specific embodiments and drawings of the present invention.

11. first component;
111. first groove;
112. first boss;
12. second component;
121. first hinge portion;
1211. first groove hole;
122. first limiting protrusion;
123. second boss;
13. third component;
131. second hinge portion;
1311. second groove hole;
132. second limiting protrusion;
133. third boss;
14. fourth component;
141. third connecting portion;
142. fourth connecting portion;
143. first pressing hole;
144. first rotating opening;
145. first pressing plate;
15. fifth component;
151. fifth limiting protrusion;
16. sixth component;
161. fifth connecting portion;
162. sixth connecting portion;
17. seventh component;
18. eighth component;
19. ninth component;
10. hinge assembly;
21. first connecting member;
211. first connecting portion;
212. second connecting portion;
2121. first hinge hole;
2122. second hinge hole;
22. second connecting member;
221. third limiting protrusion;
23. third connecting member;
231. fourth limiting protrusion;
31. first support rod;
32. second support rod;
33. third support rod;
41. first rod body;
411. first cavity;
42. second rod body;
43. third rod body;
431. third cavity;
44. fourth rod body;
51. first limiting member;
61. frame unit;
71. fence framework.

DETAILED DESCRIPTION OF THE EMBODIMENTS

To illustrate the technical contents, structural features, and achieved objectives and effects of the technical solutions in detail, the following is a detailed description combined with specific embodiments and accompanying drawings.

In the prior art, although an attempt is made to construct the side structure of the fence framework by a pair of a first upper rod body and a second upper rod body with a large length, supplemented by a single intermediate connector and a pair of oblique support rods, this design exhibits the defect of insufficient support capacity when facing large external forces, especially poor in terms of bearing capacity and stability.

Figure 1:
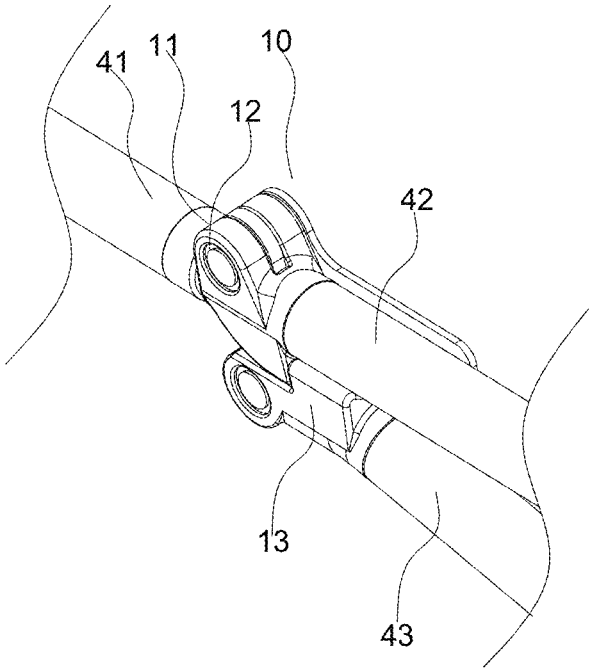
FIG. 1 is a first schematic diagram of the side structure of the specific embodiment.

In view of the above issues, this embodiment provides an improved side structure of a fence framework, aiming at significantly enhancing the stability and bearing capacity of the structure. Referring to FIG. 1, this embodiment provides a side structure of a fence framework, including a first rod body 41, a second rod body 42, a third rod body 43, a hinge assembly 10, a second support rod 32, a fourth component 14, a fifth component 15, and a sixth component 16.

The first rod body 41 and the second rod body 42 are arranged on the left and right, and the third rod body 43 is located at the lower side of the second rod body 42. The first rod body 41, the second rod body 42, and the third rod body 43 are connected by the hinge assembly 10, so that the first rod body 41, the second rod body 42, and the third rod body 43 can rotate toward or away from each other.

The second support rod 32 is located on the side of the second rod body 42 away from the third rod body 43. The fourth component 14 is slidably sleeved on the outer side of the second support rod 32 and hinged with one end of the third rod body 43 away from the first rod body 41. The fifth component 15 is fixed on the outer side of the second support rod 32 and located above the fourth component 14. The fifth component 15 and the fourth component 14 each are provided with a limiting structure. The sixth component 16 is provided at the upper end of the second support rod 32 and hinged with one end of the second rod body 42 away from the first rod body 41.

The first innovative point of this embodiment is that the first rod body and the second rod body (forming an integrated structure equivalent to the first upper rod body or the second upper rod body of the prior art) are arranged horizontally on the left and right, the third rod body is located below the second rod body, and a stable triangular foundation is formed by the third rod body, the second rod body, and the second support rod. The first rod body, the second rod body, and the third rod body are connected by the hinge assembly 10 that is carefully designed, achieving flexible rotation therebetween. Whether relative rotation or opposite movement, the overall structure can be ensured to adapt to different terrain conditions and external force impacts.

The second innovation point of this embodiment is that the second support rod not only provides direct auxiliary support for the second rod body, but also establishes a dynamic connection with the third rod body through the fourth component. The sliding sleeve design of the fourth component gives the system more adjustment space. The fifth component serves as a limiting device and is fixed on the second support rod, effectively controlling the range of movement of the fourth component and ensuring the stability of the structure during dynamic adjustment.

That is, when an external force acts on the fence, the hinge assembly 10 among the first to third rod bodies allows the structure to deform within a certain range and absorb energy, while the second support rod and its components play a role in dynamic adjustment and enhanced support. The sliding and hinge mechanism of the fourth component enables automatically fine adjustment of the fence according to the force condition, and the limiting structure of the fifth component avoids excessive deformation, ensuring structural safety. The addition of the sixth component provides additional vertical support and stability for the overall structure through hinge connection between the sixth component and the second rod body.

In addition, the length of the first rod body or the second rod body is significantly shortened compared to the length of the first upper rod body or the second upper rod body in the prior art, making it more convenient to be folded and greatly reducing the volume during storage. The compact size after folding not only facilitates transportation and storage, but also reduces the space occupied in the non-use state, improving the convenience and practicality in use.

In this embodiment, the hinge assembly 10 includes a first assembly, a second assembly, and a third assembly. The first assembly is connected to the first rod body 41, and the first assembly is provided with a first hinge hole 2121 and a second hinge hole 2122 that are spaced up and down. The first hinge hole 2121 is hinged with the second assembly, and the end of the second assembly away from the first hinge hole 2121 is connected to the second rod body 42. The second hinge hole 2122 is hinged with the third assembly, and the end of the third assembly away from the second hinge hole 2122 is hinged with the third rod body 43.

In some embodiments, unlike the manner where the first assembly has two hinge holes, and the second assembly and the third assembly are respectively hinged with the two hinge holes of the first assembly, it can be that the second assembly is provided with two hinge holes, so that the first assembly and the third assembly are respectively hinged with the two hinge holes of the second assembly.

In this embodiment, the first assembly includes a first component 11 and a first connecting member 21, the first component 11 is connected to the first rod body 41, the first connecting member 21 includes a first connecting portion 211 and a second connecting portion 212, the first connecting portion 211 and the second connecting portion 212 are set at a first predetermined angle, the first connecting portion 211 is connected to the first component 11, and the second connecting portion 212 is provided with the first hinge hole 2121 and the second hinge hole 2122.

The second assembly includes a second component 12 and a second connecting member 22, and the second component 12 is connected to the second rod body 42. The end of the second component 12 away from the second rod body 42 is provided with a first hinge portion 121 that can be inserted by the second connecting portion 212. The first hinge portion 121 is provided with a first groove hole 1211 on both sides of the first hinge hole 2121. The second connecting member 22 is located on the front or rear side of the second rod body 42. The second connecting member 22 has a first connecting hole, and the first connecting hole, the first groove hole 1211, and the first hinge hole 2121 are coaxial and a first pin runs therethrough.

The third assembly includes a third component 13 and a third connecting member 23, and the third component 13 is connected to the third rod body 43. The end of the third component 13 away from the third rod body 43 is provided with a second hinge portion 131 that can be inserted by the second connecting portion 212. The second hinge portion 131 is provided with a second groove hole 1311 on both sides of the second hinge hole 2122. The third connecting member 23 is located on the front or rear side of the third rod body 43. The third connecting member 23 has a second connecting hole, and the second connecting hole, the second groove hole 1311, and the second hinge hole 2122 are coaxial and a second pin runs therethrough.

Figure 3:
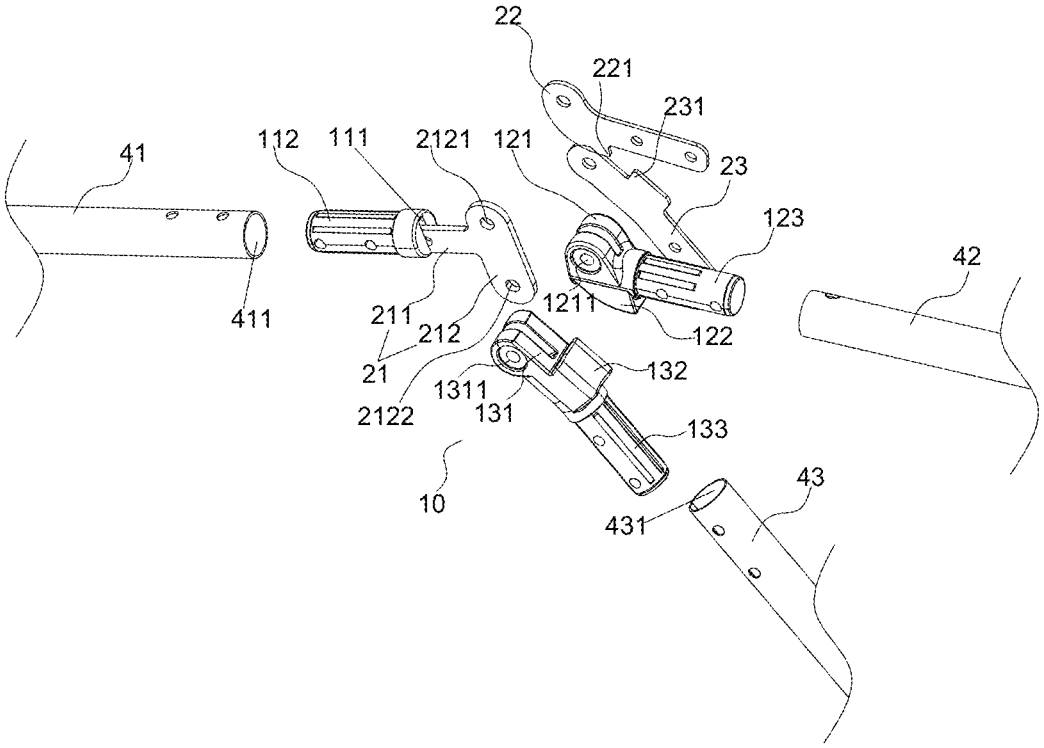
FIG. 3 is a third schematic diagram of the side structure of the specific embodiment.

Referring to FIG. 3, in this embodiment, the first component 11 is provided with a first groove 111. The first connecting portion 211 and the second connecting portion 212 are set at the first predetermined angle. The first connecting portion 211 is embedded in the first groove 111. The second connecting portion 212 and the first hinge portion 121 are hinged at the first hinge hole 2121 through a pin. The second connecting portion 212 and the second hinge portion 131 are hinged at the second hinge hole 2122 through a pin.

In this embodiment, the first component 11 is arranged at the end of the first rod body 41, the second component 12 is arranged at the end of the second rod body 42, and the third component 13 is arranged at the end of the third rod body 43. The first component 11, the second component 12, and the third component 13 are rotatably connected through the first connecting member 21. Specifically, the first connecting member 21 includes the first connecting portion 211 and the second connecting portion 212. The first connecting portion 211 and the second connecting portion 212 are set at the first predetermined angle. The specific value of the first predetermined angle can be set according to actual needs. As shown in FIG. 3, the first predetermined angle is 90 degrees, and the first connecting portion 211 and the second connecting portion 212 are connected to form an L shape.

Specifically, the first component 11 has the first groove 111, and the first connecting portion 211 is placed in the first groove 111. Optionally, the first component 11 and the first connecting portion 211 can be fastened and connected by a locking or fastening member. The second component 12 has the first hinge portion 121, the second connecting portion 212 is provided with the first hinge hole 2121, and the first hinge portion 121 and the first hinge hole 2121 can be hinged through a pin shaft. The third component 13 has the second hinge portion 131, the second connecting portion 212 is provided with the second hinge hole 2122, and the second hinge portion 131 and the second hinge hole 2122 can be hinged through a pin shaft.

Preferably, the first connecting portion 211 and the second connecting portion 212 form a T shape or a Y shape.

It should be noted that this embodiment does not limit the positional relationship between the second rod body 42 and the third rod body 43. In some preferred embodiments, the second rod body 42 is arranged above the third rod body 43, and the first hinge hole 2121 and the second hinge hole 2122 are spaced in a vertical direction.

Figure 6:
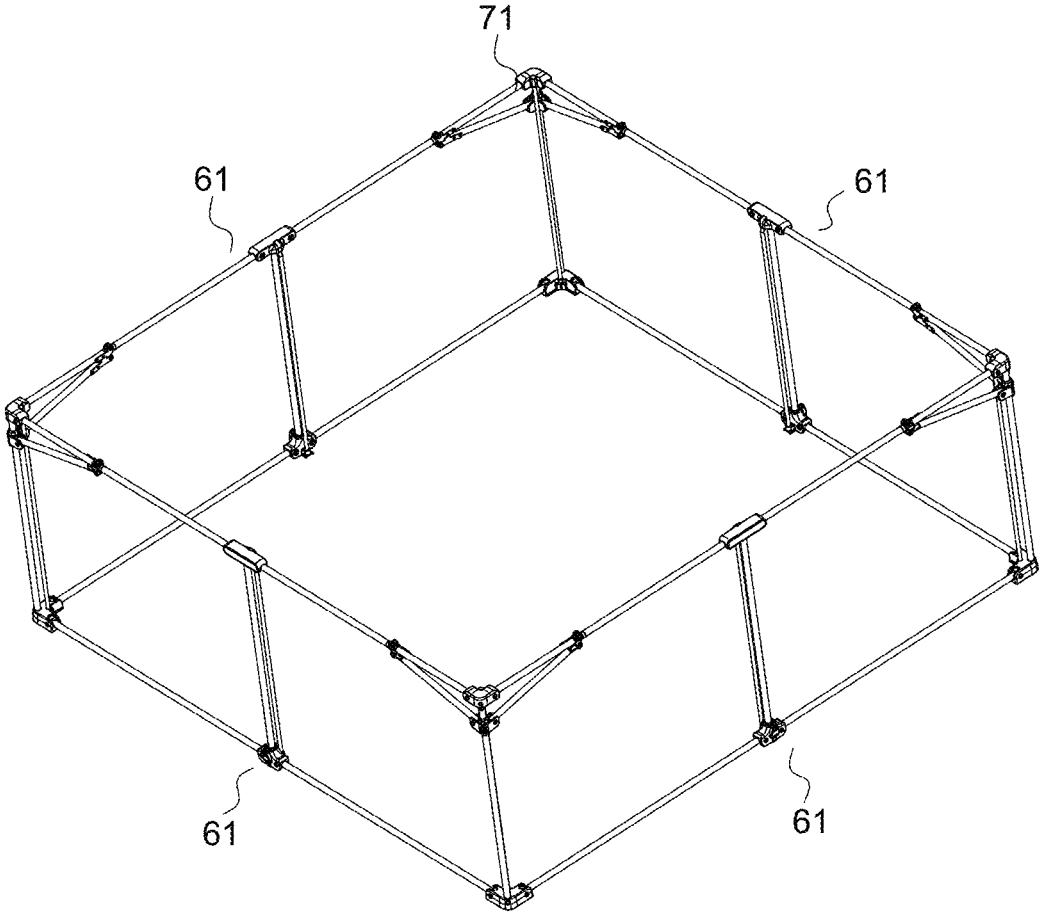
FIG. 6 is a schematic diagram of the fence of the specific embodiment in an unfolded state.

In this embodiment, the other end of the first rod body 41 is hinged with the end of a first support rod 31, one end of the second rod body 42 is hinged with the end of the second support rod 32, and the third rod body 43 is movably connected to the second support rod 32. When the second rod body 42 and the third rod body 43 rotate toward each other under the drive of the second component 12, the third component 13, and the first connecting member 21, the distance between the first support rod 31 and the second support rod 32 can be enlarged. At the same time, the first rod body 41, the second rod body 42, and the third rod body 43 are stretched to a state close to a straight line, that is, at this time, the joint between the second rod body 42 and the third rod body 43 still has a certain radian. At this time, the first rod body 41, the second rod body 42, and the third rod body 43 are in a fully unfolded state, and the first support rod 31 is farthest from the second support rod 32, that is, the overall fence framework 71 is in an unfolded state, as shown in FIG. 6.

When the third rod body 43 and the second rod body 42 move away from each other, the second support rod 32 moves toward the first support rod 31, further driving the first rod body 41 to bend obliquely downward, the second rod body 42 to bend obliquely upward, and the third rod body 43 to bend obliquely downward until the distance between the second support rod 32 and the first support rod 31 is minimum. The specific change process is shown in FIG. 7 to FIG. 10 to implement the folding operation of the overall fence framework 71.

Referring to FIG. 3, in this embodiment, the second connecting member 22, the third connecting member 23, and the first connecting member 21 are all sheet structures, where the second connecting member 22 is locked on the outer surface of the end of the second rod body 42 by a fastening member, and the third connecting member 23 is locked on the outer surface of the end of the third rod body 43 by a fastening member. Preferably, the second connecting member 22 and the third connecting member 23 are arranged on the same side, the first connecting hole, the first groove hole, and the first hinge hole 2121 are coaxial, and the second connecting hole, the second groove hole, and the second hinge hole 2122 are coaxial. When a pin shaft is used for hinge connection, the second connecting member 22 and the third connecting member 23 can reinforce the hinge area of the second component 12 and the third component 13, thereby improving the connection stability between the second rod body 42, the third rod body 43 and the first rod body 41.

In this embodiment, when in use, the second component 12 and the third component 13 can be directly rotated toward each other and then abut against each other to fix the second rod body 42 and the third rod body 43, and at the same time, the first rod body 41, the second rod body 42, and the third rod body 43 are in a fully unfolded state, so that the distance between the first support rod 31 and the second support rod 32 are maximum, and the first support rod 31, the second support rod 32, the first rod body 41, the second rod body 42, and the third rod body 43 form the side structure of a fence. When the fence needs to be stored, only the second component 12 and the third component 13 are required to be rotated away from each other, which, due to inertia, can drive the first support rod 31 and the second support rod 32 to approach to each other, thereby completing the folding operation of the overall fence side and facilitating the use.

Figure 2:
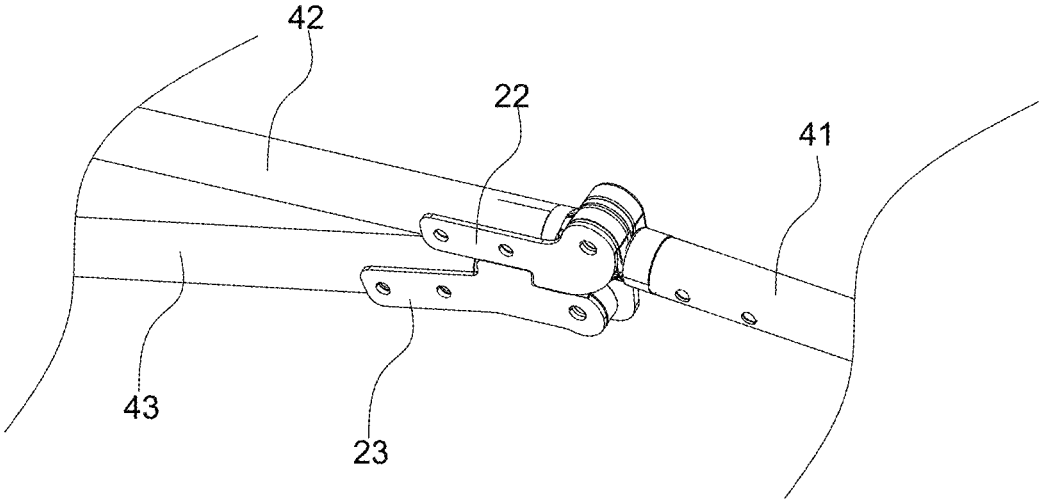
FIG. 2 is a second schematic diagram of the side structure of the specific embodiment.

In this embodiment, referring to FIG. 2 and FIG. 3, in some embodiments, the second component 12 has a first limiting protrusion 122, and the first limiting protrusion 122 is arranged on the side of the second component 12 facing the third component 13. The third component 13 has a second limiting protrusion 132, and the second limiting protrusion 132 is arranged on the side of the third component 13 facing the second component 12. The first limiting protrusion 122 can be rotated to a first predetermined position under the drive of the second rod body 42, and the second limiting protrusion 132 can be rotated to a second predetermined position under the drive of the third rod body 43, so that the first limiting protrusion 122 and the second limiting protrusion 132 stop each other, making the first rod body 41 and the second rod body 42 remain relatively fixed.

In this embodiment, the second component 12 has the first limiting protrusion 122, the first limiting protrusion 122 has a first limiting surface, and the first limiting surface is arranged facing the second rod body 42. The third component 13 has the second limiting protrusion 132, the second limiting protrusion 132 has a second limiting surface, and the second limiting surface is arranged facing the side where the first connecting member 21 is located. When the first limiting surface and the second limiting surface are rotated to a certain position, the first limiting surface abuts against the second limiting surface, thereby making the first limiting protrusion 122 abut against the second limiting protrusion 132, that is, the second rod body 42 abuts against the third rod body 43, so that the second rod body 42 and the third rod body 43 remain relatively fixed.

Referring to FIG. 2, in some embodiments, the first limiting protrusion 122 is further provided with a first guiding surface, and the first guiding surface is arranged on the side of the first limiting protrusion 122 facing the third rod body 43; and/or, the second limiting protrusion 132 is further provided with a second guiding surface, and the second guiding surface is arranged on the side of the second limiting protrusion 132 facing the second rod body 42.

In this embodiment, the first guiding surface is an arc surface that is set as shown in FIG. 2 and adapts to the rotation direction of the second rod body 42. The first guiding surface can abut against the third component 13 when the second rod body 42 is rotated, until the second limiting protrusion 132 of the third component 13 abuts against the first limiting protrusion 122, that is, the first guiding surface guides the second limiting protrusion 132.

In some embodiments, the second limiting protrusion 132 is further provided with a second guiding surface, the second guiding surface can be inwardly concave, and the second guiding surface is used to guide the outer side wall of the second rod body 42 to prevent the second rod body 42 from deviating from the position directly above the third rod body 43 during the rotation process.

Referring to FIG. 3, in some embodiments, the second connecting member 22 is provided with a third limiting protrusion 221, the third limiting protrusion 221 has a third limiting surface, and the third limiting surface and the first limiting surface are placed on the same reference plane. The third connecting member 23 is provided with a fourth limiting protrusion 231, the fourth limiting protrusion 231 has a fourth limiting surface, and the fourth limiting surface and the second limiting surface are placed on the same reference plane. In this configuration, the third component 13 and the second component 12 can be further reinforced when they abut against each other, thereby improving the connection stability between the second rod body 42 and the third rod body 43.

Referring to FIG. 3, in some embodiments, the first component 11 has a first boss 112, the end of the first rod body 41 has a first cavity 411, and the first boss 112 is placed in the first cavity 411; and/or, the second component 12 has a second boss 123, the end of the second rod body 42 has a second cavity, and the second boss 123 is placed in the second cavity; and/or, the third component 13 has a third boss 133, the end of the third rod body 43 has a third cavity 431, and the third boss 133 is placed in the third cavity 431. Optionally, a fastening member may be provided at the joint between the first boss 112 and the first rod body 41 to further improve the connection stability between the first component 11 and the first boss 112. Similarly, a fastening member may be provided at the joint between the second boss 123 and the second rod body 42, and a fastening member may be provided at the joint between the third boss 133 and the third rod body 43 to strengthen the connection stability between the second rod body 42 and the second component 12 and between the third rod body 43 and the third component 13, while making it simpler and more attractive.

Figure 4:
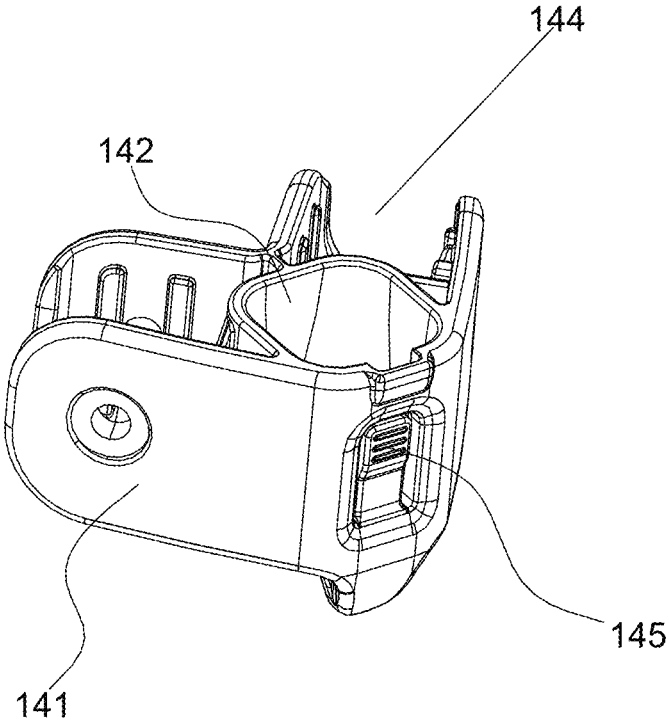
FIG. 4 is a fourth schematic diagram of the side structure of the specific embodiment.
Figure 5:
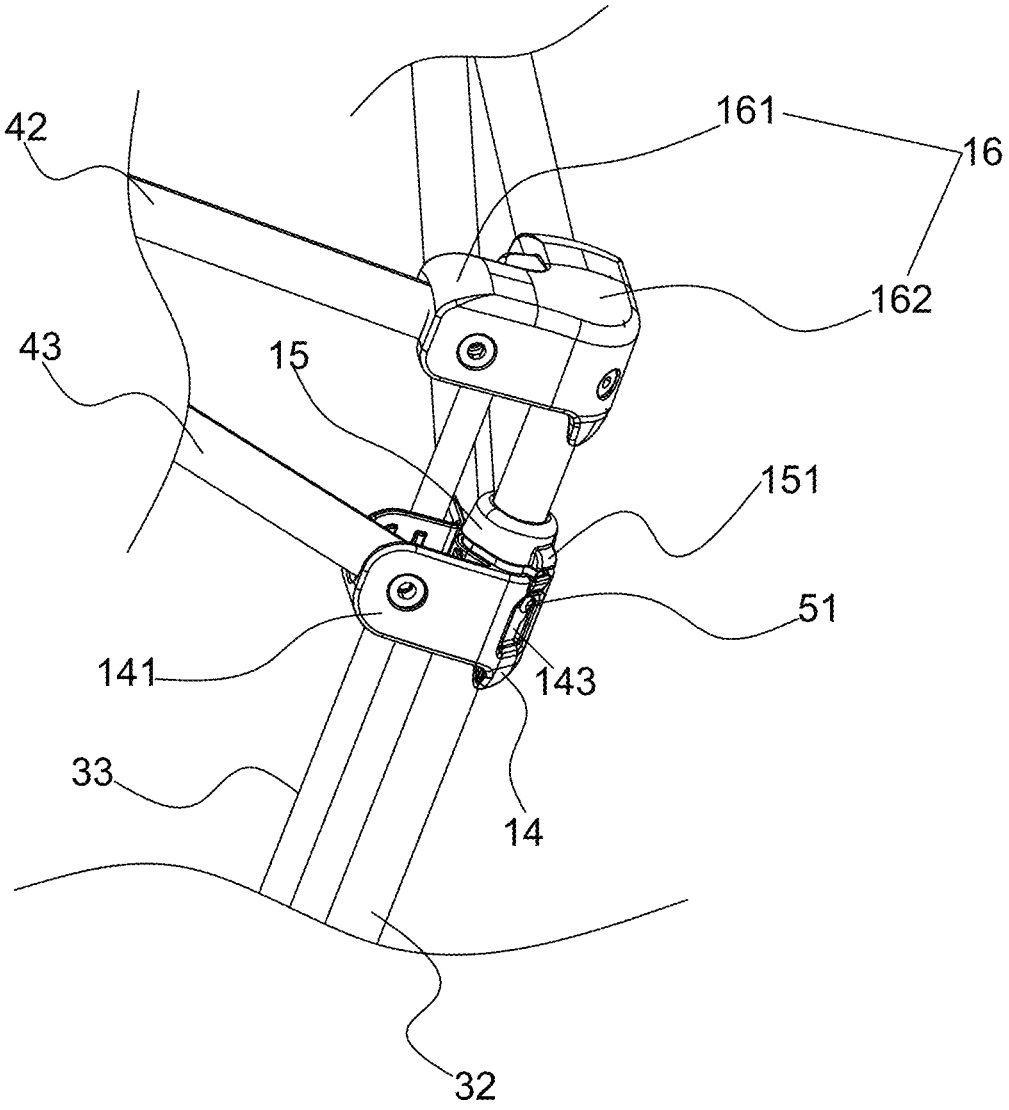
FIG. 5 is a fifth schematic diagram of the side structure of the specific embodiment.

Referring to FIG. 4 and FIG. 5, in this embodiment, the fourth component 14 is provided with a fourth connecting portion 142 and at least one third connecting portion 141. One of the at least one third connecting portion 141 is hinged with one third rod body 43, the fourth connecting portion 142 is sleeved on the outside of the second support rod 32, the fourth component 14 can slide up and down relative to the second support rod 32, the fourth connecting portion 142 is provided with a first pressing hole 143, the third connecting portion 141 has a first rotating opening 144, and the third rod body 43 can rotate relative to the third connecting portion 141 in the first rotating opening 144.

The second support rod 32 is provided with a first limiting member 51, a part of the first limiting member 51 protrudes out of the outer side wall of the second support rod 32, and a first elastic member is provided between the first limiting member 51 and the second support rod 32.

When the fourth component 14 moves to a predetermined position, the first limiting member 51 is placed in the first pressing hole 143, and a part of the first limiting member 51 protrudes out of the first pressing hole 143, so that the fourth component 14 is fixed relative to the second support rod 32.

In this embodiment, optionally, the number of the third connecting portion 141 can be set according to actual needs. For example, when the same second support rod 32 is shared, the number of the third connecting portion 141 is two, and one of the third connecting portions 141 is hinged with one third rod body 43. The third connecting portion 141 is provided with the first rotating opening 144, and the opening angle of the first rotating opening 144 can be set according to actual needs. In this configuration, the rotation range of the third rod body 43 can be restricted. The fourth connecting portion 142 is arranged adjacent to the third connecting portion 141, and the third connecting portion 141 is arranged on the outside of the fourth connecting portion 142. The fourth connecting portion 142 is sleeved on the second support rod 32 and can slide up and down relative to the second support rod 32. The third connecting portion 141 is hinged with the third rod body 43, and the end of the third rod body 43 can move up and down relative to the second support rod 32.

Referring to FIG. 5, in this embodiment, the limiting structure includes the first limiting member, and the first limiting member 51 is arranged on the fifth component 15 through the first elastic member. The fifth component 15 has a fifth limiting protrusion 151, and the fifth limiting protrusion 151 is placed at a predetermined position to limit the fourth component 14.

The fifth component 15 is sleeved on the second support rod 32. The fifth limiting protrusion 151 is a convex portion protruding toward the outside, which specifically can be a convex ring. The fifth limiting protrusion 151 shown in FIG. 5 has an obvious convex portion and a convex ring, which makes the fifth component 15 more attractive. Optionally, the first limiting member 51 is arranged on the fifth component 15 to reduce the impact on the structural integrity of the second support rod 32 and to improve the support strength of the second support rod 32.

In this embodiment, the fifth component 15 has a non-circular cross section and can be inserted into the fourth component 14. The cross section of the fourth connecting portion 142 of the fourth component 14 is matched with the non-circular cross section of the fifth component. The fifth component 15 can only be raised and lowered in the fourth connecting portion 142 and cannot be rotated left and right, which is conducive to the alignment of the various parts of the limiting structure. Preferably, the portion of the fifth component 15 that is inserted into the fourth component 14 is conical, which can also play a limiting role.

In this embodiment, the first limiting member 51 can be understood as a button-type structure. The first elastic member is provided between the first limiting member 51 and the second support rod 32. The first elastic member can be compressed when the first limiting member 51 is pressed, so that the first limiting member 51 is embedded in the second support rod 32. When the force acting on the first limiting member 51 is removed, the elastic potential energy of the first elastic member is released, so that the end of the first limiting member 51 protrudes out of the second support rod 32. The first pressing hole 143 is provided on the fourth connecting portion 142. The first limiting member 51 can protrude out of the first pressing hole 143 when the fourth connecting portion 142 slides to a predetermined position, that is, when the first pressing hole 143 is coaxial with the first limiting member 51, the first limiting member 51 can directly protrude out of the first pressing hole 143, thereby fixing the fourth connecting portion 142. The predetermined position here is the position where the end of the third rod body 43 is located on the second support rod 32 when the second rod body 42 abuts against the third rod body 43.

Referring to FIG. 4, in some embodiments, the fourth component 14 is further provided with a first pressing plate 145, and the first pressing plate 145 serves as a part of the limiting structure. The first pressing plate 145 covers the first pressing hole 143. When in use, the first pressing plate 145 can be pressed to press the first limiting member 51, which can increase the force area of the human hand during the pressing process, thus improving use comfort. It should be noted that the first pressing hole 143 and the first pressing plate 145 serve as a part of the limiting structure.

When the third rod body 43 needs to be rotated, the first limiting member 51 can be pressed through the first pressing hole 143, so that the fourth connecting portion 142 is released from the state of fixing with the second support rod 32 and slides relative to the second support rod 32 to adjust the rotation angle of the third rod body 43.

Referring to FIG. 5, in this embodiment, the sixth component 16 is arranged at the end of the second support rod 32. The sixth component 16 has a sixth connecting portion 162 and at least one fifth connecting portion 161. One of the at least one fifth connecting portion 161 is hinged with the end of one second rod body 42. The sixth connecting portion 162 is fixedly connected to the end of the second support rod 32. The fifth connecting portion 161 has a second rotating opening. The second rod body 42 can rotate relative to the fifth connecting portion 161 in the second rotating opening. Optionally, the number of the fifth connecting portion 161 can be set according to actual needs. For example, when the same second support rod 32 is shared, the number of the fifth connecting portion 161 is two, and one of the fifth connecting portions 161 is hinged with one second rod body 42. The fifth connecting portion 161 has the second rotating opening. The opening angle of the second rotating opening can be set according to actual needs. In this configuration, the rotation range of the second rod body 42 can be restricted. It can be seen that the second rotating opening is arranged toward the first rotating opening 144, which adapts to the rotation of the second rod body 42 and the third rod body 43.

In this embodiment, when in use, the second component and the third component can be directly rotated toward each other and then abut against each other to fix the second rod body and the third rod body, and at the same time, the first rod body, the second rod body, and the third rod body are in a fully unfolded state, so that the distance between the first support rod and the second support rod are maximum, and the first support rod, the second support rod, the first rod body, the second rod body, and the third rod body form the side structure of a fence. When the fence needs to be stored, only the second component and the third component are required to be rotated away from each other, which, due to inertia, can drive the first support rod and the second support rod to approach to each other, thereby completing the folding operation of the overall fence side and facilitating the use.

Figure 7:
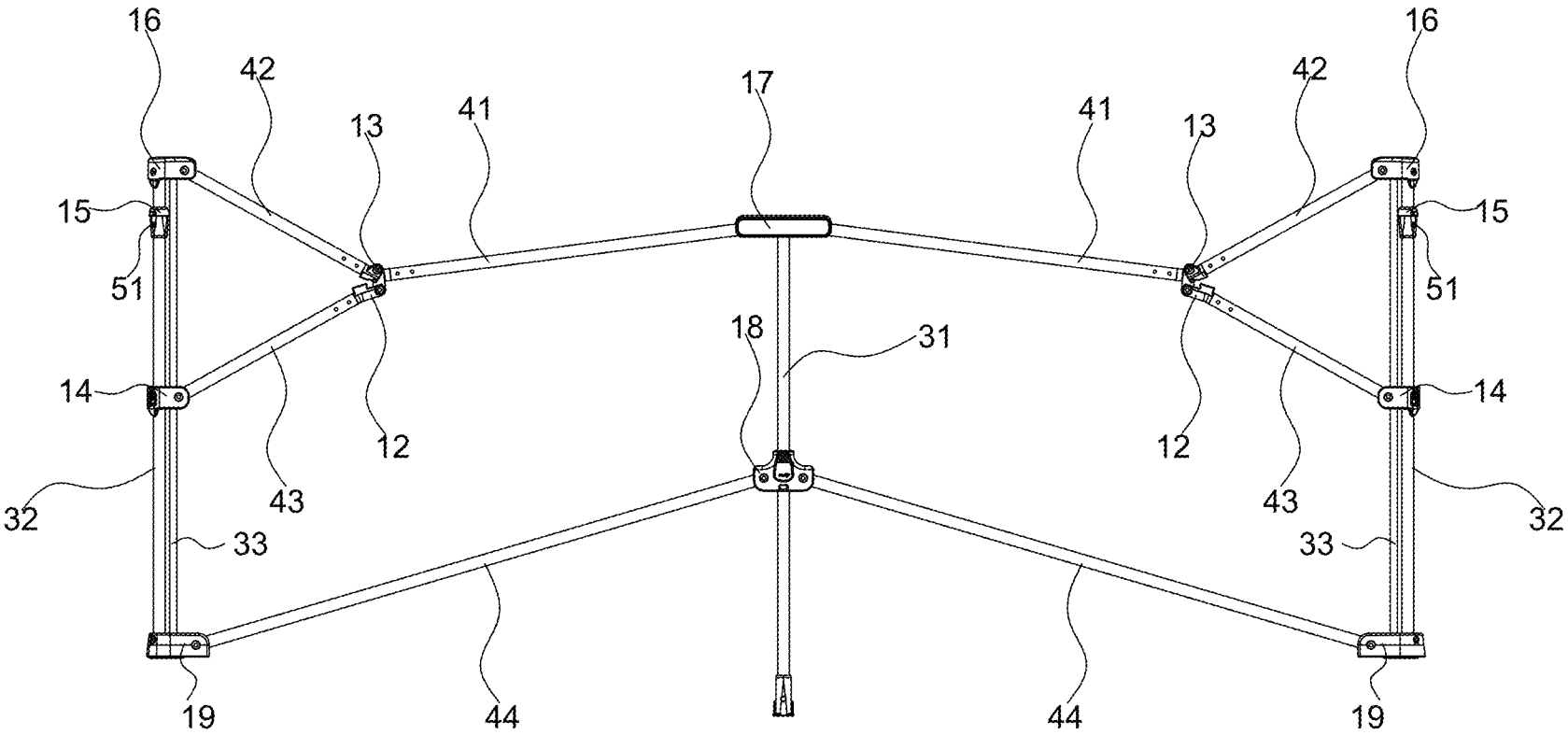
FIG. 7 is a schematic diagram of the fence of the specific embodiment in a folded state.
Figure 8:
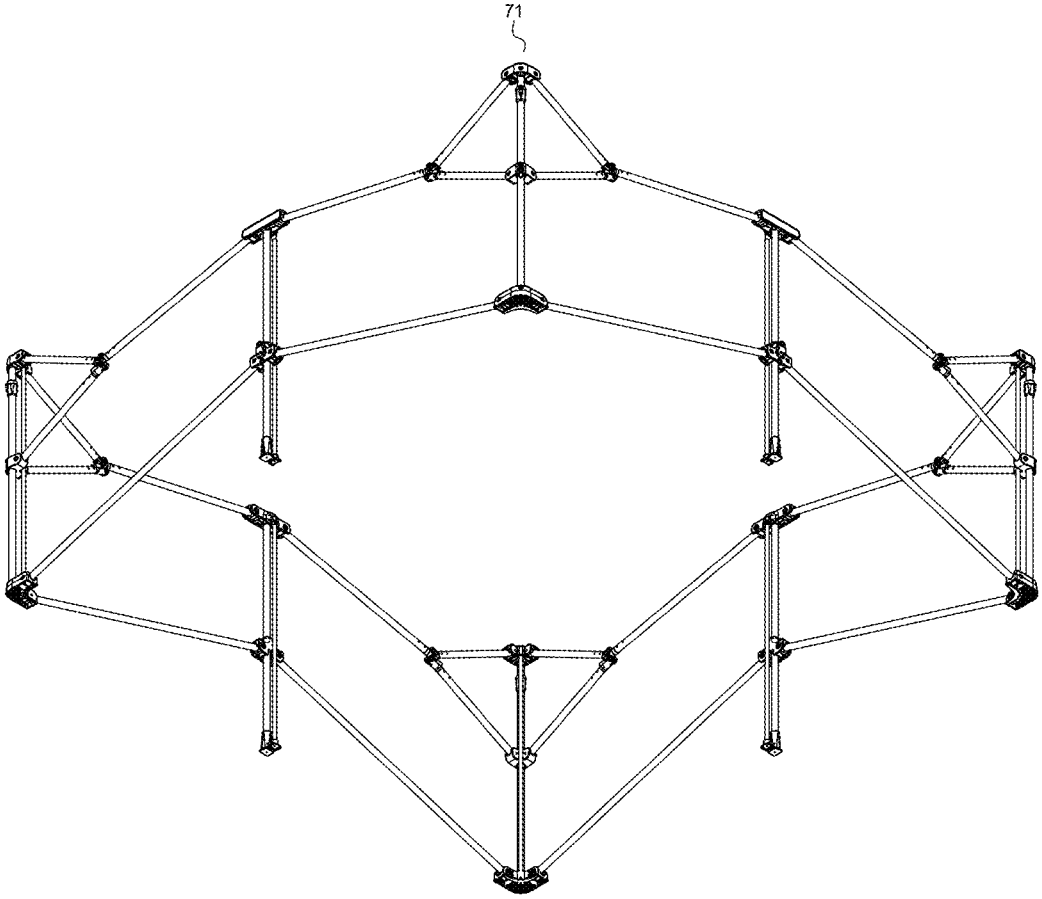
FIG. 8 is another schematic diagram of the fence of the specific embodiment in the folded state.
Figure 9:
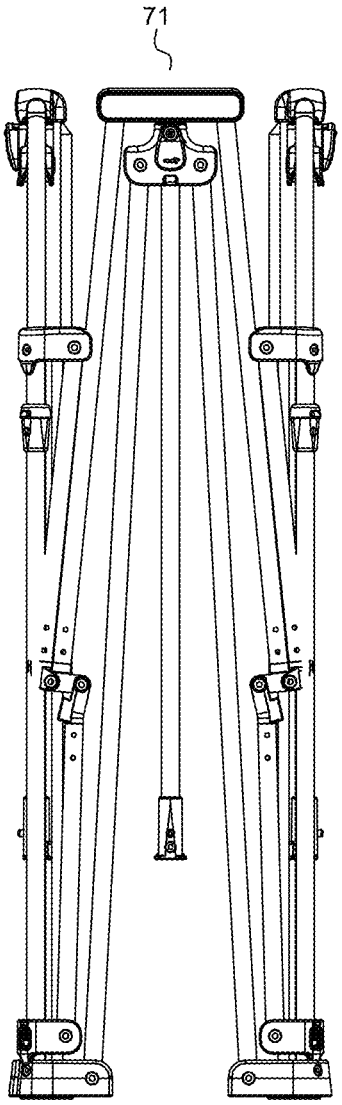
FIG. 9 is a schematic diagram of the fence of the specific embodiment in a completely folded state.
Figure 10:
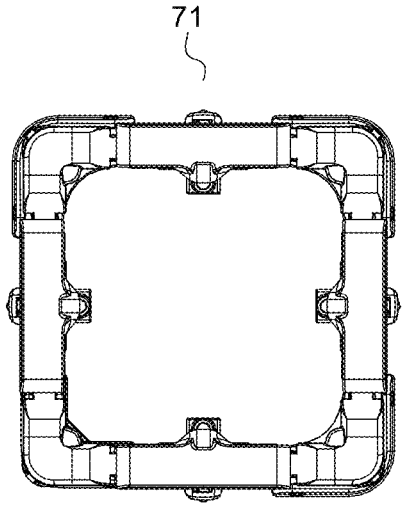
FIG. 10 is a top view of FIG. 9.

Referring to FIG. 5 and FIG. 7, in this embodiment, the side structure further includes a third support rod 33. The upper end of the third support rod 33 is provided with the sixth component 16. The third support rod 33 and the second support rod 32 are parallel and have the same length. The third support rod 33 plays a role in strengthening the side structure. If the side structure only has the second support rod, it can be called a single-rod structure. If the side structure has the second support rod and the third support rod, it can be called a double-rod structure. Of course, the side structure can also be a three-rod structure, a four-rod structure, a five-rod structure, etc., and the three-rod structure has one second support rod and two third support rods.

In this embodiment, the lower end of the third support rod 33 is provided on a ninth component 19. Optionally, the second support rod 32 is respectively sleeved with the ninth component 19 and the sixth component 16, and the third support rod 33 is respectively sleeved with the ninth component 19 and the sixth component 16. The difference between the third support rod 33 and the second support rod 32 is that the third support rod 33 is located on the outer side of the second support rod 32 and is not connected to the fourth component 14 and the fifth component 15.

Referring to FIG. 6 and FIG. 7, this embodiment provides a fence framework, including a side structure, a seventh component 17, the first support rod 31, an eighth component 18, and the ninth component 19. The side structure is the side structure of the fence framework described in any of the above embodiments. The end of the first rod body 41 of the side structure away from the second rod body 42 is hinged with the seventh component 17, the middle of the seventh component 17 is hinged with the upper end of the first support rod 31, the eighth component 18 is slidably sleeved on the outside of the first support rod 31, the eighth component 18 is hinged with one end of the fourth rod body 44, the other end of the fourth rod body 44 is hinged with the ninth component 19, the ninth component 19 is fixed to the bottom end of the second support rod 32, and two side structures and two ninth components 19 are symmetrically arranged on the left and right sides of the seventh component 17 and the first support rod 31 to form a frame unit 61.

One frame unit 61 is one side structure of the fence framework 71, including two sub-side structures located on the left and right sides, and the seventh component 17, the eighth component 18, the first support rod 31, and the fourth rod body 44 are arranged between the two sub-side structures. The length of the first rod body 41, the hinge assembly 10, and the second rod body 42 as a whole is roughly the same as the length of the fourth rod body 44, and the length of the first support rod 31 is the same as the length of the second support rod 32, so as to form a small rectangular frame (a half of the frame unit 61).

In this embodiment, four frame units 61 form the fence framework 71, where two adjacent frame units 61 share the ninth component 19 as well as the sixth component, the fifth component, the fourth component, and the second support rod of the side structure, and the fence framework 71 is in the shape of a rectangular frame.

That is, the sixth component is hinged with two second rod bodies, respectively, the fourth component is hinged with two third rod bodies, respectively, and the ninth component 19 is connected to two fourth rod bodies, respectively.

In the embodiment with the third support rod, in the two adjacent frame units 61, the third support rod between the sixth component 16 and the ninth component 19 is also shared.

In this embodiment, the side structure of the fence framework 71 includes, according to function, the first support rod 31 and the second support rod 32 that play a main supporting role, and the first rod body 41, the second rod body 42, and the third rod body 43 that play an intermediate connecting role. The side structure of the fence framework 71 shown in this embodiment is reflected in the folding structure of the first rod body 41, the second rod body 42, and the third rod body 43, which can realize the adjustment of the distance between the first support rod 31 and the second support rod 32, thereby realizing the overall folding and unfolding of the fence framework 71.

Referring to FIG. 6 to FIG. 10, this embodiment provides a fence, including the fence framework described in the above embodiment and a fabric cover covering the side and bottom of the fence framework.

Referring to FIG. 6 to FIG. 10, this embodiment provides a folding method of a fence, which is applicable to the fence described in the above embodiment. The folding method includes:

controlling the second rod body 42 and the third rod body 43 to rotate away from each other relative to the hinge assembly 10;

controlling the first rod body 41 to rotate downward to a first limited position relative to the first support rod 31;

controlling the second rod body 42 to rotate to a second limited position relative to the second support rod 32; and controlling the third rod body 43 to slide downward to a third limited position relative to the second support rod 32, so as to drive the second support rod 32 to fold toward the first support rod 31.

In the above technical solution, the side structure includes the first component 11, the second component 12, the third component 13, the first connecting member 21, the first support rod 31, the first rod body 41, the second support rod 32, the second rod body 42, and the third rod body 43. The first connecting member 21 includes the first connecting portion 211 and the second connecting portion 212. The first connecting portion 211 and the second connecting portion 212 are set at the first predetermined angle. The first connecting portion 211 is embedded in the first groove 111. The second connecting portion 212 is provided with the first hinge hole 2121 and the second hinge hole 2122 arranged at intervals. The second connecting portion 212 and the first hinge portion 121 are hinged at the first hinge hole 2121, and the second connecting portion 212 and the second hinge portion 131 are hinged at the second hinge hole 2122. The second rod body 42 and the third rod body 43 can be rotated toward or away from each other on the connecting structure composed of the first component 11, the second component 12, the third component 13, and the first connecting member 21. When in use, the second component 12 and the third component 13 can be directly rotated toward each other and then abut against each other to fix the second rod body 42 and the third rod body 43, and at the same time, the first rod body 41, the second rod body 42, and the third rod body 43 are in a fully unfolded state, so that the distance between the first support rod 31 and the second support rod 32 are maximum, and the first support rod 31, the second support rod 32, the first rod body 41, the second rod body 42, and the third rod body 43 form the side structure of a fence. When the fence needs to be stored, only the second component 12 and the third component 13 are required to be rotated away from each other, which, due to inertia, can drive the first support rod 31 and the second support rod 32 to approach to each other, thereby completing the folding operation of the overall fence side and facilitating the use.

It should be noted that, in this disclosure, the relational terms, such as first and second, etc., are only used to distinguish one entity or operation from another entity or operation, and do not necessarily require or imply any such actual relationship or order between these entities or operations. Moreover, the terms "include", "comprise", or any other variants thereof are intended to cover non-exclusive inclusion, so that a process, method, article, or terminal device including a series of elements includes not only those elements, but also other elements not explicitly listed, or also includes elements inherent to such process, method, article, or terminal device. In the absence of further limitations, the elements defined by the phrase "include . . . " or "comprise . . . " do not exclude the existence of additional elements in the process, method, article, or terminal device including the elements. In addition, in this disclosure, "greater than", "less than", "exceed", and the like are understood to exclude the number itself; "above", "below", "within", and the like are understood to include the number itself.

Although the above embodiments have been described, once those skilled in the art know the basic inventive concepts, they can make additional changes and modifications to these embodiments. Therefore, the above description is only embodiments of the present invention and does not limit the patent protection scope of the present invention. Any equivalent structure or equivalent process transformation made by using the contents of the specification and drawings of the present invention, or directly or indirectly used in other related technical fields, is also included in the patent protection scope of the present invention.

What is claimed is:

1. A side structure of a fence framework, comprising a first rod body, a second rod body, a third rod body, a hinge assembly, a second support rod, a fourth component, a fifth component, and a sixth component; wherein the first rod body and the second rod body are arranged on the left and right, the third rod body is located at a lower side of the second rod body, and the first rod body, the second rod body, and the third rod body are connected by the hinge assembly, so that the first rod body, the second rod body, and the third rod body are configured to rotate toward or away from each other;

the second support rod is located on a side of the second rod body away from the third rod body, the fourth component is slidably sleeved on an outer side of the second support rod and hinged with one end of the third rod body away from the first rod body, the fifth component is fixed on the outer side of the second support rod and located above the fourth component, the fifth component and the fourth component each are provided with a limiting structure, and the sixth component is provided at an upper end of the second support rod and hinged with one end of the second rod body away from the first rod body.

2. The side structure of the fence framework according to claim 1, wherein the hinge assembly comprises a first assembly, a second assembly, and a third assembly, the first assembly is connected to the first rod body, the first assembly is provided with a first hinge hole and a second hinge hole spaced up and down, the first hinge hole is hinged with the second assembly, an end of the second assembly away from the first hinge hole is connected to the second rod body, the second hinge hole is hinged with the third assembly, and an end of the third assembly away from the second hinge hole is hinged with the third rod body.

3. The side structure of the fence framework according to claim 2, wherein the first assembly comprises a first component and a first connecting member, the first component is connected to the first rod body, the first connecting member comprises a first connecting portion and a second connecting portion, the first connecting portion and the second connecting portion are set at a first predetermined angle, the first connecting portion is connected to the first component, and the second connecting portion is provided with the first hinge hole and the second hinge hole;

the second assembly comprises a second component and a second connecting member, the second component is connected to the second rod body, an end of the second component away from the second rod body is provided with a first hinge portion configured to be inserted by the second connecting portion, the first hinge portion is provided with a first groove hole on both sides of the first hinge hole, the second connecting member is located on a front or rear side of the second rod body, the second connecting member has a first connecting hole, and the first connecting hole, the first groove hole, and the first hinge hole are coaxial and a first pin runs therethrough;

the third assembly comprises a third component and a third connecting member, the third component is connected to the third rod body, an end of the third component away from the third rod body is provided with a second hinge portion configured to be inserted by the second connecting portion, the second hinge portion is provided with a second groove hole on both sides of the second hinge hole, the third connecting member is located on a front or rear side of the third rod body, the third connecting member has a second connecting hole, and the second connecting hole, the second groove hole, and the second hinge hole are coaxial and a second pin runs therethrough.

4. The side structure of the fence framework according to claim 3, wherein the second component has a first limiting protrusion, and the first limiting protrusion is arranged on a side of the second component facing the third component;

the third component has a second limiting protrusion, and the second limiting protrusion is arranged on a side of the third component facing the second component;

the first limiting protrusion has a first limiting surface, the first limiting surface faces the second rod body, the second limiting protrusion has a second limiting surface, the second limiting surface depart from the third rod body, the first limiting surface and the second limiting surface are configured to abut against each other, so that the second rod body and the third rod body remain relatively fixed.

5. The side structure of the fence framework according to claim 4, wherein the second connecting member is provided with a third limiting protrusion, the third limiting protrusion has a third limiting surface, and the third limiting surface and the first limiting surface are placed on the same reference plane; the third connecting member is provided with a fourth limiting protrusion, the fourth limiting protrusion has a fourth limiting surface, and the fourth limiting surface and the second limiting surface are placed on the same reference plane.

6. The side structure of the fence framework according to claim 1, wherein the fourth component is provided with a fourth connecting portion and at least one third connecting portion, one of the at least one third connecting portion is hinged with one third rod body, the fourth connecting portion is sleeved on an outside of the second support rod, the fourth component is configured to slide up and down relative to the second support rod, the fourth connecting portion is provided with a first pressing hole, the third connecting portion has a first rotating opening, and the third rod body is configured to rotate relative to the third connecting portion in the first rotating opening;

the second support rod is provided with a first limiting member, a part of the first limiting member protrudes out of an outer side wall of the second support rod, and a first elastic member is provided between the first limiting member and the second support rod;

when the fourth component moves to a predetermined position, the first limiting member is placed in the first pressing hole, and a part of the first limiting member protrudes out of the first pressing hole, so that the fourth component is fixed relative to the second support rod.

7. The side structure of the fence framework according to claim 6, wherein the fifth component has a non-circular cross section and is configured to be inserted into the fourth connecting portion of the fourth component, and a cross section of the fourth connecting portion is matched with the non-circular cross section of the fifth component.

8. The side structure of the fence framework according to claim 6, wherein the limiting structure comprises the first limiting member, the first limiting member is arranged on the fifth component through the first elastic member, the fifth component has a fifth limiting protrusion, and the fifth limiting protrusion is placed at a predetermined position to limit the fourth component.

9. The side structure of the fence framework according to claim 1, further comprising a third support rod, wherein an upper end of the third support rod is provided with the sixth component, and the third support rod is parallel to the second support rod.

10. A fence framework, comprising a side structure, a seventh component, a first support rod, an eighth component, and a ninth component, wherein the side structure is the side structure of the fence framework according to claim 1, an end of the first rod body of the side structure away from the second rod body is hinged with the seventh component, a middle of the seventh component is hinged with an upper end of the first support rod, the eighth component is slidably sleeved on an outside of the first support rod, the eighth component is hinged with one end of the fourth rod body, the other end of the fourth rod body is hinged with the ninth component, the ninth component is fixed to a bottom end of the second support rod, and two side structures and two ninth components are symmetrically arranged on the left and right sides of the seventh component and the first support rod to form a frame unit.

11. The fence framework according to claim 10, wherein four frame units form the fence framework, two adjacent frame units share the ninth component as well as the sixth component, the fifth component, the fourth component, and the second support rod of the side structure, and the fence framework is in a shape of a rectangular frame.

12. A fence, comprising the fence framework according to claim 10 and a fabric cover covering the side and bottom of the fence framework.

13. A folding method of a fence, applicable to the fence according to claim 12, comprising:

controlling the second rod body and the third rod body to rotate away from each other relative to the hinge assembly;

controlling the first rod body to rotate downward to a first limited position relative to the first support rod;

controlling the second rod body to rotate to a second limited position relative to the second support rod; and controlling the third rod body to slide downward to a third limited position relative to the second support rod, so as to drive the second support rod to fold toward the first support rod.

* * * * *